US006546958B1

(12) United States Patent
Parker et al.

(10) Patent No.: US 6,546,958 B1
(45) Date of Patent: Apr. 15, 2003

(54) MULTIPLE CAVITY VALVE PLATE WITH FLOATING SHOE FOR CONTAINER LABELING APPARATUS

(75) Inventors: Joseph Parker, Modesto, CA (US); Gary Gomes, Antelope, OR (US)

(73) Assignee: B & H Manufacturing Company, Inc., Ceres, CA (US)

( * ) Notice: Subject to any disclaimer, the term of this patent is extended or adjusted under 35 U.S.C. 154(b) by 0 days.

(21) Appl. No.: 10/010,032

(22) Filed: Nov. 30, 2001

(51) Int. Cl.[7] ..... B65C 9/14

(52) U.S. Cl. ..... 137/597; 137/907; 156/215; 156/446; 156/DIG. 31

(58) Field of Search ..... 137/597, 907; 156/215, 256, 446, 567, DIG. 3, DIG. 13, DIG. 26, DIG. 31, DIG. 37, DIG. 38, DIG. 39; 271/276

(56) References Cited

U.S. PATENT DOCUMENTS 4,589,945 A * 5/1986 Polit ..... 156/497
4,724,036 A * 2/1988 Hill et al. ..... 156/497
5,104,306 A * 4/1992 Gordon et al. ..... 156/571
5,344,519 A * 9/1994 Galchefski et al. ..... 156/444
5,486,253 A * 1/1996 Otruba ..... 156/215
5,855,710 A * 1/1999 Hinton ..... 156/215
5,964,974 A * 10/1999 Hinton ..... 156/215
6,066,223 A * 5/2000 Gomes et al. ..... 156/215

* cited by examiner

*Primary Examiner*—Michael Powell Buiz
*Assistant Examiner*—Ramesh Krishnamurthy
(74) *Attorney, Agent, or Firm*—LaRiviere, Grubman & Payne, LLP

(57) ABSTRACT

A multiple port valve plate assembly for use with a vacuum drum in a labeling apparatus. The valve plate has a first stationary vacuum cavity which is supplied with one level of vacuum suitable for picking up a label segment from a cutter with limited tension. The valve plate has a second, floating cavity, which is supplied with another, higher level of vacuum suitable for firmly griping the cut label segment as an adhesive is applied to the label segment. The valve plate has a third stationary vacuum cavity for suitable for holding the label at a lower vacuum pressure while the label is being transferred to a container. The third cavity may be further divided into a label application segment with an even lower vacuum pressure. A pressure port is also provided adjacent the third cavity for facilitating release of the label from the vacuum drum as it contacts the container.

27 Claims, 5 Drawing Sheets

MULTIPLE CAVITY VALVE PLATE WITH FLOATING SHOE FOR CONTAINER LABELING APPARATUS

BACKGROUND OF THE INVENTION

1. Field of the Invention

The present invention pertains generally to a method of labeling containers in which a stationary vacuum plate assembly provides different levels of vacuum to a rotating vacuum drum used to support segments of label material, and more particularly to a vacuum drum with a floating shoe to provide improved control over label segments during processing.

2. Description of the Background Art

Labeling containers by applying preprinted film labels is a popular alternative to conventional lithography. Various environmental problems, including air pollution and recycling concerns, strongly favor adoption of preprinted films for labeling containers. Plastic containers, metal cans and glass bottles can be labeled effectively with film labels.

Cost considerations have led to the development of thin films which have the advantage of reducing the cost of materials used, but require increasingly more stringent process controls to allow high speed labeling equipment to handle thin, stretchable, and relatively flimsy labeling materials.

Labeling speed is an important consideration in high production canning and bottling plants, since it is unacceptable for labeling processes to impede productivity of a bottling or canning line. Labeling speed is of paramount importance, with labeling speeds in excess of ten containers per second being possible to achieve with some labeling materials. Generally, thicker materials that are resistant to stretching are easier to handle by conventional labeling machines.

When thin labeling materials are run at high speeds, problems, such as label splitting, stretching labels and misalignment of labels, are encountered. With roll-fed labels, when the labels are cut from the web of label material, excessive tension on the label can cause the labels to split instead of being cut. Similarly, over-tensioning thin labels can cause the labels to stretch as they are applied to the vacuum drum. As the labels are transferred to a vacuum drum, excessive vacuum can cause the label segment to shift or snap, leading to misaligned labels on the containers.

Some labeling materials include coatings or treatments that result in higher coefficients of friction that can interfere with the labeling process. Labels having a higher coefficient of friction tend to become over-tensioned more easily, which aggravates problems associated with over-tensioning.

Another problem encountered when labels are supported by a vacuum drum during the labeling process is that glue applicators for applying glue to the label segments can become jammed by labels if insufficient vacuum is provided to prevent the labels from following the glue applicator.

Therefore, there is a need for a method of selectively controlling the amount of vacuum supplied to a vacuum drum during different stages of the labeling process. The present invention satisfies that need, as well as others, and overcomes deficiencies found in current label handling techniques.

BRIEF SUMMARY OF THE INVENTION

The present invention pertains to a multiple-port valve plate assembly for use with a rotating vacuum drum in a label apparatus of the type described in U.S. Pat. No. 5,486,253, which is incorporated herein by reference. By way of example, and not of limitation, the apparatus generally comprises a disk-shaped valve body, having first and second arcuate-shaped stationary vacuum cavities, and a floating shoe positioned in a receptacle in the valve body intermediate to the position of the first and second stationary vacuum cavities. The floating shoe, which moves within the receptacle, has a third arcuate-shaped vacuum cavity that also moves, or "floats", in the valve body with the floating shoe. A spring material, such as sponge rubber, is positioned between the floating shoe and the inner wall of the receptacle so as to hold the floating shoe against the wear plate in the system. One of the stationary vacuum cavities is divided into two spaced-apart arcuate-shaped segments that are interconnected by a channel in the valve body, and a vacuum control valve is provided for controlling the amount of vacuum supplied by the interconnecting channel to one of the segments. In addition, a pressure port for blow-off is also provided in the valve body. Each of the stationary vacuum cavities and the floating shoe include vacuum fittings configured for coupling the cavities to separate sources of vacuum.

The first stationary vacuum cavity is configured to be supplied with a level of vacuum suitable for the vacuum drum picking up a label segment from a cutter with limited tension. The intermediate floating cavity is configured to be supplied with another, higher level of vacuum suitable for the vacuum drum firmly griping the cut label segment as an adhesive is applied to the label segment. The second stationary vacuum cavity is configured to be supplied with a lower level of vacuum suitable for the vacuum drum holding the label while the label is being transferred to a container. The pressure port is configured to be provided with a high pressure for facilitating release of the label from the vacuum drum as it contacts the container.

The present invention improves the seal between the fixed valve plate and the rotating vacuum drum at the point of high vacuum so that vacuum loss is reduced. This reduced vacuum loss has the advantage of allowing a smaller vacuum source to be used to maintain the high vacuum level, thus reducing the cost of the vacuum pump or generator, thereby reducing the operational cost to produce the vacuum. It also provides a more precise control of the vacuum at the point of adhesive application and eliminates the spread of high vacuum to adjacent ports that can negatively affect the label cutting and application by changing the vacuum level in these adjacent ports and chambers on a random basis. On a standard valve plate, the vacuum seal can be affected by warping and/or wear of the plate caused by heat and general use. The floating shoe reduces the effect of warping or wear by reducing the contact surface area at the critical high vacuum point. It also reduces the amount of heat generated because the force between the valve plate and the vacuum drum required to maintain a good vacuum seal is concentrated over a small surface area. By reducing the heat, the potential for warping and general wear of the valve plate is reduced, which is particularly important during high speed labeling.

An object of the invention is to provide a vacuum plate assembly with a plurality of cavities for providing different levels of vacuum to a vacuum drum in a container labeling apparatus, wherein thin films can be swiftly and accurately applied with minimum scrap or wastage.

Another object of the invention is to provide a vacuum plate assembly with a plurality of cavities for providing different levels of vacuum to a vacuum drum in a container labeling apparatus, wherein ultra-thin stretchable film can be applied without reducing labeling speeds or over-tensioning label material during the labeling process.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 6. It will be appreciated that the apparatus may vary as to configuration and as to details of the parts, and that the method may vary as to the specific steps and sequence, without departing from the basic concepts as disclosed herein.

Figure 1:
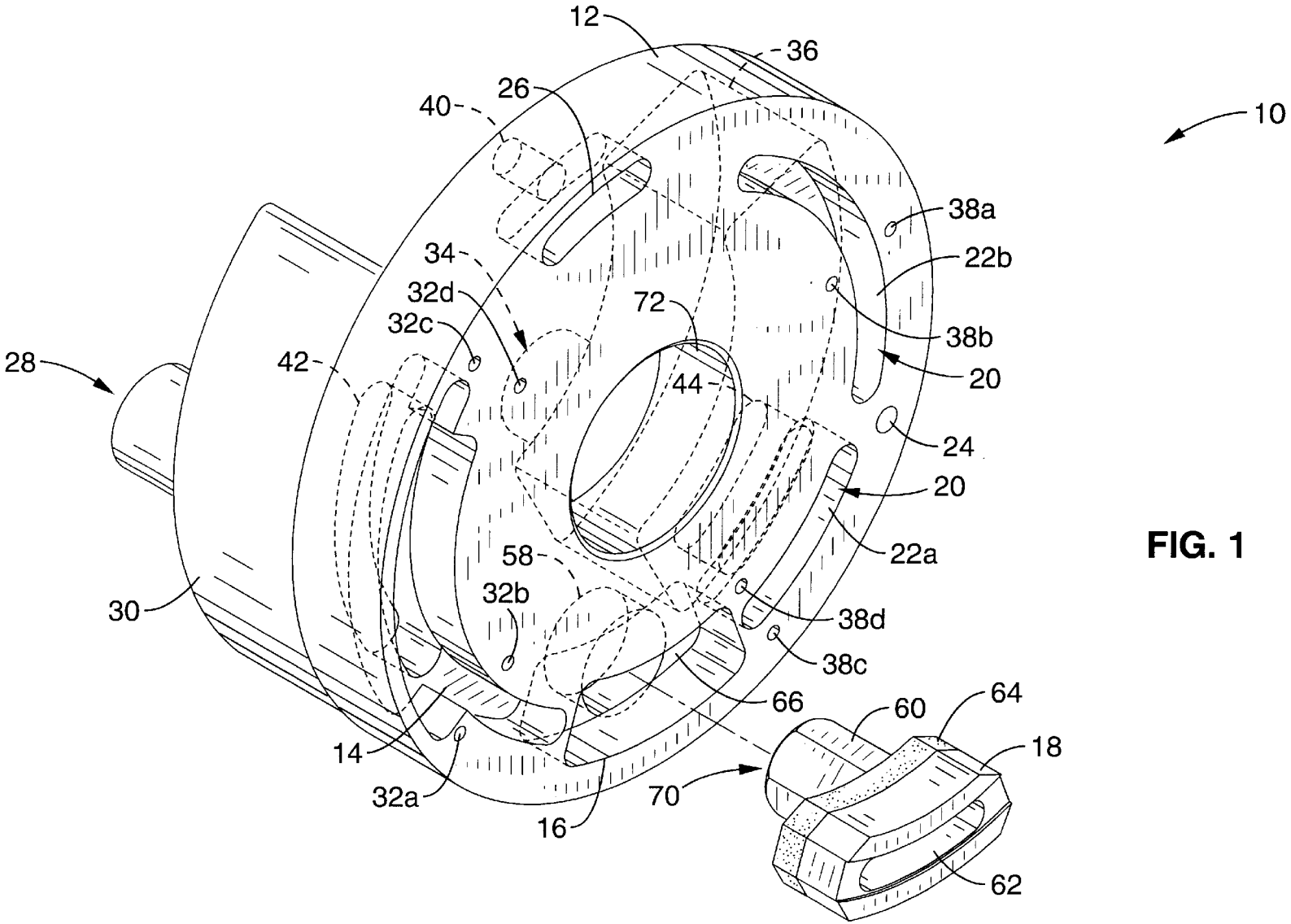
FIG. 1 a bottom perspective view of a multiple port vacuum plate assembly according to the present invention with the floating shoe shown exploded from the assembly.

Referring first to FIG. 1, a multiple cavity vacuum valve plate assembly 10 according to the present invention is shown. The assembly shown is used as a component of a vacuum drum in a labeling apparatus and method as described in U.S. Pat. No. 5,486,253, which is incorporated herein by reference. Accordingly, the details of the vacuum drum and operation of the labeling apparatus and method will not be repeated herein.

Figure 2:
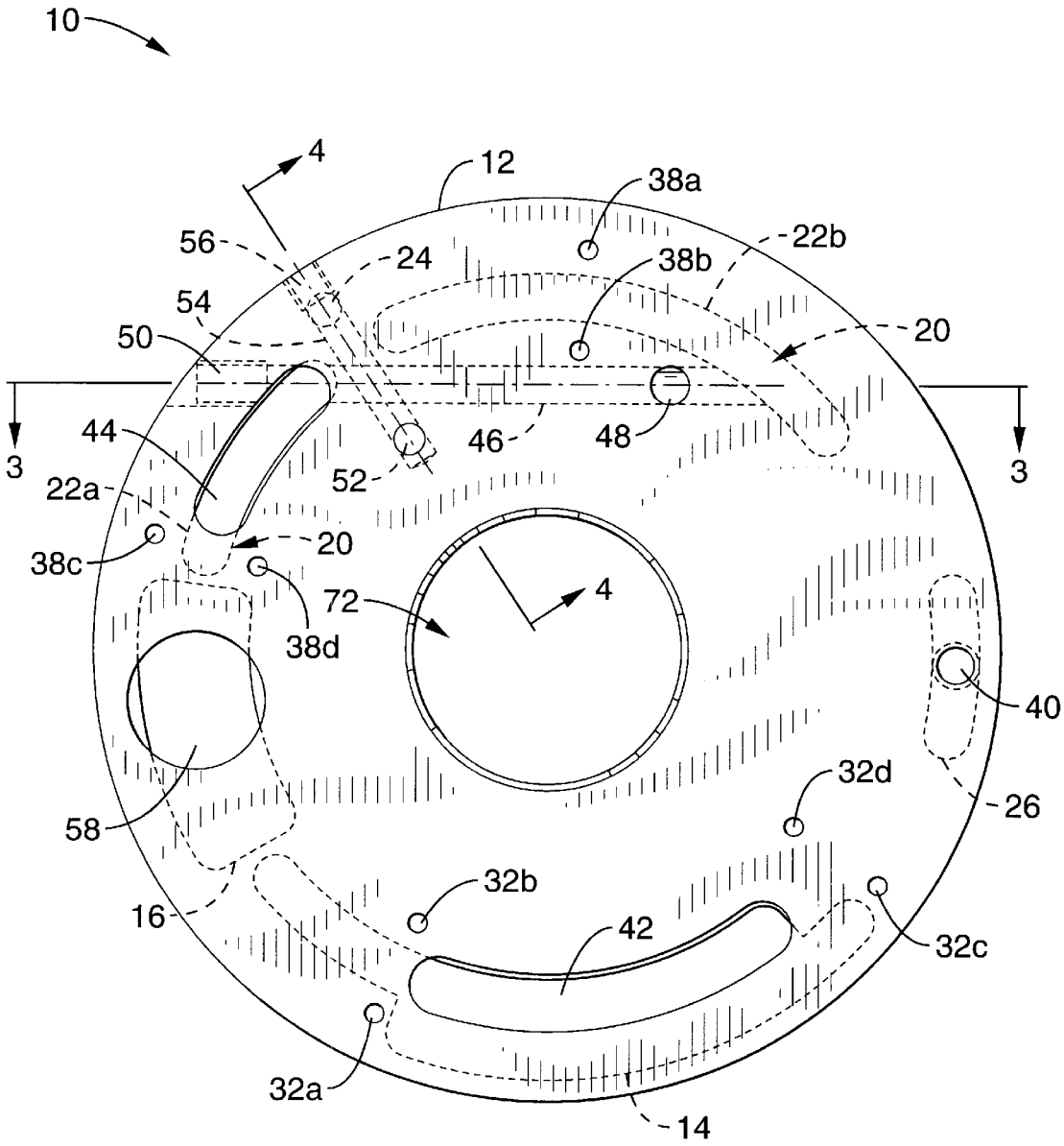
FIG. 2 is a bottom plan view of the valve body portion of the assembly shown in FIG. 1 showing the internal cavities and interconnections.

As can be seen in FIG. 1, valve plate assembly 10 includes a disk-shaped valve body 12 with a stationary arcuate-shaped low vacuum cavity 14, an arcuate-shaped receptacle 16 for receiving a floating shoe 18, a stationary low vacuum cavity 20 having arcuate-shaped first and second segments 22*a*, 22*b*, a stationary circular-shaped high pressure blow-off port 24, and a stationary arcuate-shaped high pressure blow-off port 26. Vacuum cavity 14 is configured to receive a vacuum supply through an inlet port 28 in a vacuum fitting 30 which is mounted to the upper surface of valve body 12 with standard fasteners, such as screws, extending from the vacuum fitting into receptacles 32*a* through 32*d*. Vacuum cavity 20 is configured to be connected to a low vacuum supply through an inlet port 34 in a vacuum fitting 36, which is mounted to the upper surface of valve body 12 with standard fasteners extending from the vacuum fitting into receptacles 38*a* through 38*d*. It will be appreciated that the vacuum level in these arcuate vacuum cavities will decrease with the distance away from the inlet ports. Blow-off port 24 is configured to be connected to a high pressure supply through an inlet pressure port 52 (FIG. 2). Blow-off port 26 is configured to be connected to a high pressure air supply through an inlet pressure port 40.

Figure 3:
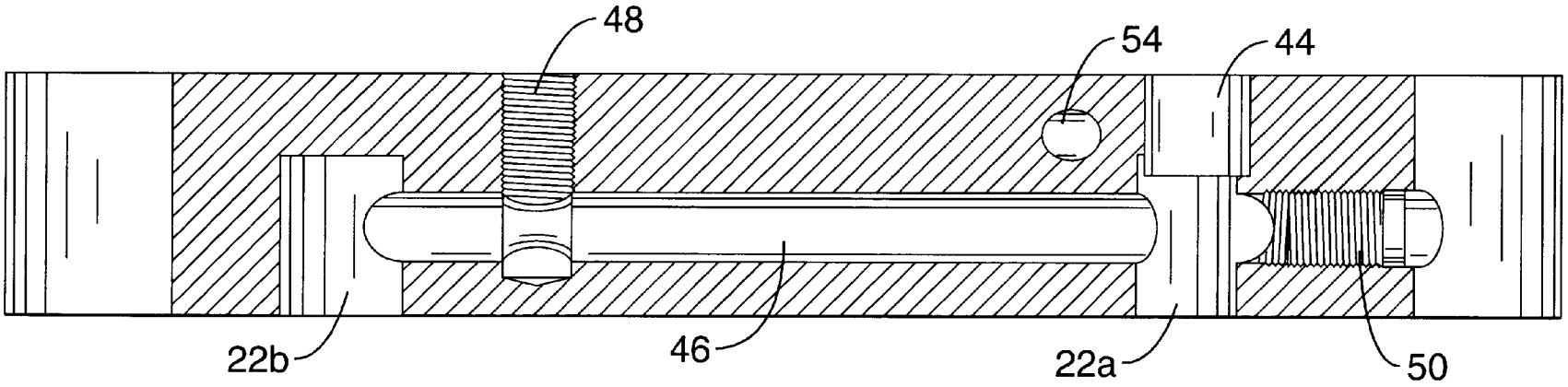
FIG. 3 is a cross-sectional view of the valve body shown in FIG. 2 taken through line 3—3.
Figure 4:
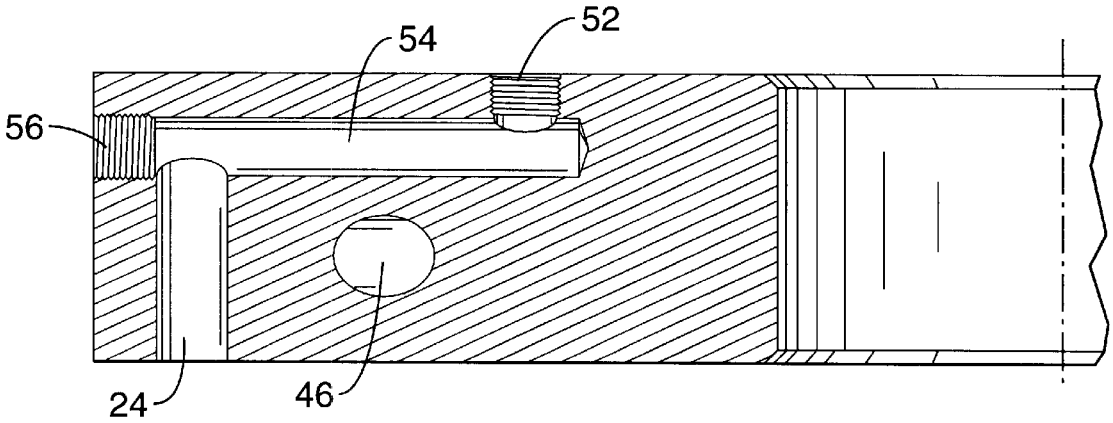
FIG. 4 is a cross-sectional view of valve body shown in FIG. 2 taken through line 4—4.

Referring now to FIG. 2 through FIG. 4, the position and relationship of the cavities and ports are shown in more detail. First, it can be seen that cavity 14 opens into an inlet port 42 in the upper surface of valve body 12 that mates with a corresponding port in vacuum fitting 30 and connects to inlet port 28 . Similarly, cavity segment 22*a* opens into an inlet port 44 in the upper surface of valve body 12 that mates with a corresponding port (not shown) in vacuum fitting 36. Note that cavities 22*a*, 22*b* are interconnected internally to valve body 12 by means of a cross-connecting channel 46 that is cross-drilled in valve body 12. It will be appreciated that the vacuum level to cavity 22*b* will be lower than that in cavity 22*a* due to the distance from inlet port 34. For even greater control, a control port 48 through the upper surface of valve body 12 is provided in channel 46 that can be used with a plug, screw valve or the like to adjust the vacuum level to cavity 22*b*. A plug 50 is provided to seal off the end of channel 46 in the sidewall of valve body 12 where the channel was drilled. It can also be seen that blow-off port 24 is connected to inlet port 52 in the upper surface of valve body 12 though a channel 54 that is cross-drilled in valve body 12. A plug 56 is provided to seal off the end of channel 54 in the sidewall of valve body 12 where the channel was drilled.

Figure 5:
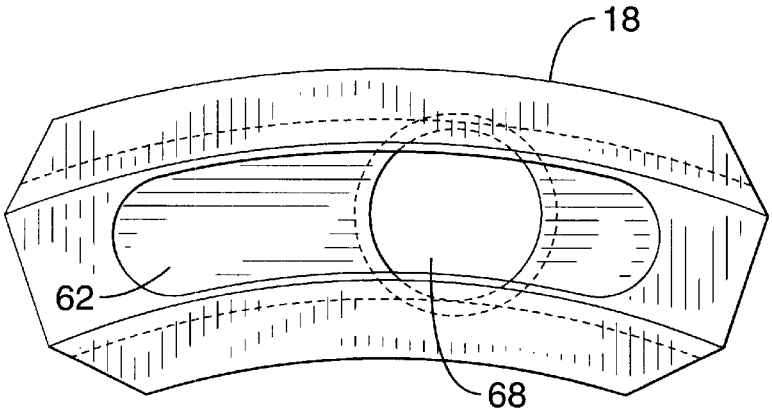
FIG. 5 is a bottom plan view of the floating shoe shown in FIG. 1.

Referring to FIG. 1, FIG. 2 and FIG. 5, floating shoe 18 fits within receptacle 16 in valve body 12. Receptacle 16 opens into a hole 58 through which a vacuum fitting 60 attached to floating shoe 18 extends. In turn, vacuum fitting 60 opens into an arcuate cavity 62 within floating shoe 18. It will be appreciated, therefore, that cavity 62 is not stationary within valve body 12 as is the case with the other cavities. Instead, cavity 62 moves or "floats" within receptacle 16. A spring material 64, such as foam rubber or sponge, is attached to floating shoe 18 and positioned between floating shoe 18 and inner wall 66 of receptacle 16 to hold floating shoe 18 against the wear plate in the system. Alternatively, one or more separate or nested coil springs could be used. Vacuum fitting 60 is screwed into a threaded hole 68 in floating shoe 18 or otherwise attached to floating shoe 18 in such a way as to create flow communication between port 70 in vacuum fitting 60 and cavity 62. Port 70 is configured to be connected to a high vacuum supply.

An opening 72 is provided through which a drive shaft (not shown) for the rotating vacuum drum (not shown) can extend. As described in U.S. Pat. No. 5,486,253, valve plate assembly 10 remains fixed in a stationary position while a rotating vacuum drum rotates around the circumference of valve plate assembly 10.

Operationally, cavity 14 is a low vacuum cavity to facilitate transfer of cut label segments from the cutter to the vacuum drum, floating shoe 18 provides a higher vacuum level to facilitate retention of cut label segments on the vacuum drum, cavity 20 is a lower vacuum cavity to facilitate transfer of label segments from the vacuum drum to the container (e.g., label roll-on), and blow-off ports 24 and 26 are high pressure ports for blow off to further facilitate transfer of label segments from the vacuum drum to the container being labeled. Note that it is important that a low vacuum level be provided to cavity 14 to minimize tension on the label as it is being transferred from the cutter to the vacuum drum. Splitting or misalignment of the label can occur if excessive tension is exerted by the vacuum drum on the label segment as it pulls the leading edge of the label segment off of the cutter drum and onto and around the vacuum drum. Once the cut label segment is picked up by the vacuum drum, the high vacuum provided by floating shoe 18 retains the label segment in place as it moves into position for glue application. The high level of vacuum retention prevents slippage and misalignment of the label segment as the vacuum drum rotates the label into position for glue application. The high level of vacuum also prevents the label segment from following the glue roller that can lead to the label segment becoming caught in the glue applicator.

After the glue application stage, the vacuum level is reduced as the label segment is applied to the container. Blow-off port 24 aids in separating the label from the vacuum drum as it is applied to the container. Note that blow-off port 24 is positioned to release the label segments at a point where the vacuum drum will initially contact the containers being labeled. The lower vacuum cavity segment 22*b* after blow-off port 24 is provided for holding the label in place during transfer to the container to prevent misalignment thereon and to prevent mismatch of the leading and trailing edges. Blow-off port 26 aids in the final separation and transfer of the label to the container.

Figure 6:
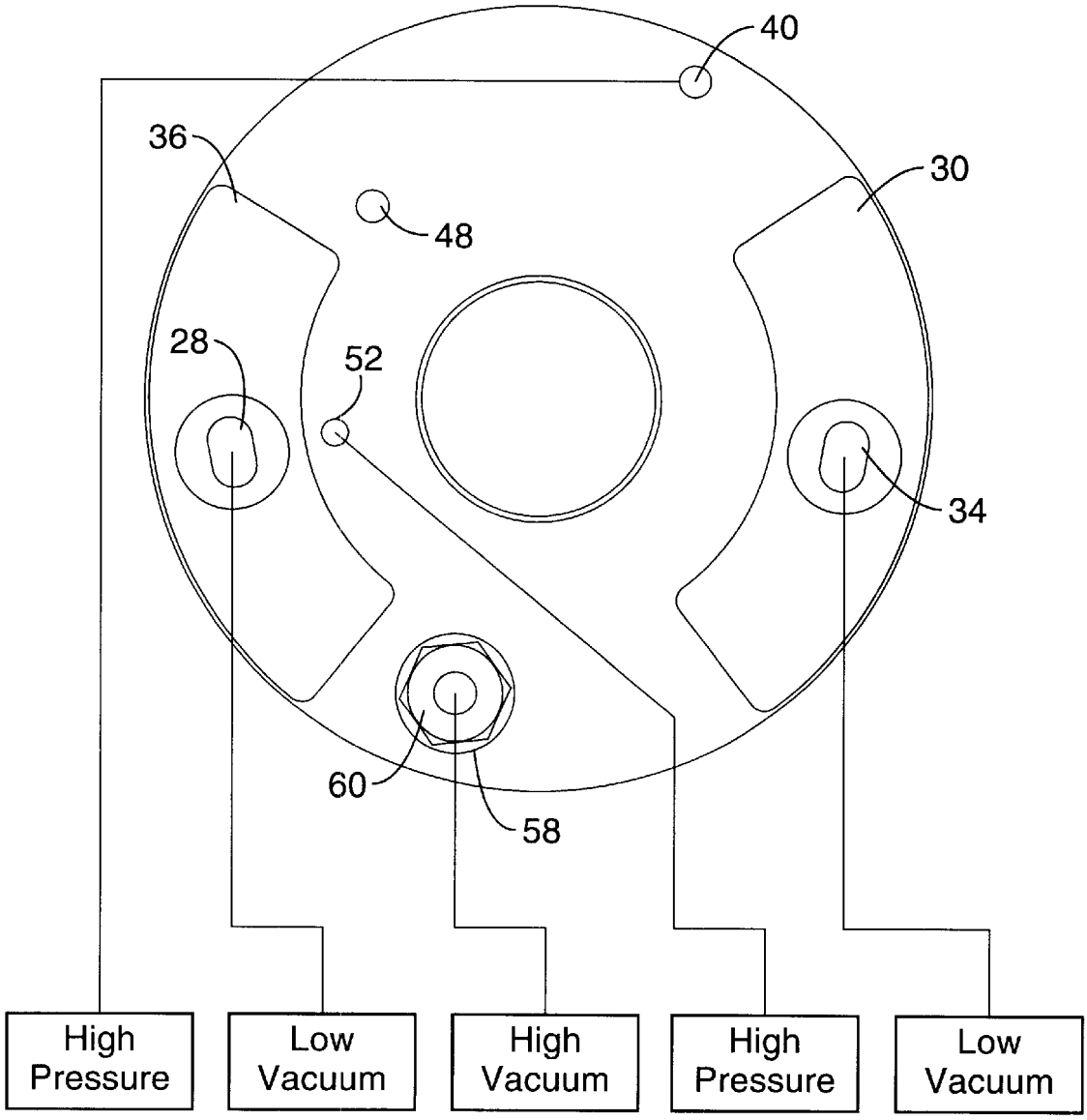
FIG. 6 is a top plan schematic view of the assembly shown in FIG. 1 connected to vacuum and pressure supplies.

Referring also to FIG. 6, a vacuum source or multiple vacuum sources, provide the same or different low vacuum levels to cavities 14 and 20 through first 28 and second 34 low pressure vacuum inlets in vacuum 30, 36, respectively. A separate vacuum source provides the high vacuum level to cavity 62 in floating shoe 18 through inlet port 70. A high pressure source provides the blow-off pressure supply to blow-off port 24 through inlet port 52. Lastly, the same or a separate high pressure source provides the blow-off pressure supply to blow-off port 26 through inlet port 40.

Accordingly, it will be seen that this invention provides multiple vacuum and pressure supplies to facilitate cut label segments being picked up by a vacuum drum, holding the label segments on the vacuum drum while adhesive is applied to the label segments, and applying the label segments to containers. The floating shoe changes position based on the presence or absence of vacuum, and functions as a continuously variable valve to equalize vacuum variations due to, for example, changes in rotational speed of the valve body or changes in label porosity.

Although the description above contains many specificities, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A multiple cavity valve plate for a vacuum drum in a container labeling apparatus, comprising:

a valve body;

a stationary vacuum cavity in said valve body; and a moveable vacuum cavity in said valve body, wherein said moveable vacuum cavity is positioned in a floating shoe in a receptacle in said valve body.

2. A multiple cavity valve plate as recited in claim 1, further comprising a spring disposed between said floating shoe and said receptacle.

3. A multiple cavity valve plate as recited in claim 1, wherein said floating shoe includes a vacuum fitting in flow communication with said moveable vacuum cavity.

4. A multiple cavity valve plate as recited in claim 1, further comprising a pressure port in said valve body.

5. A multiple cavity valve plate as recited in claim 1, wherein said stationary vacuum cavity includes first and second cavity segments interconnected by a channel in said valve body.

6. A multiple cavity valve plate as recited in claim 5, further comprising a vacuum control valve fluidically coupled to said interconnecting channel.

7. A multiple cavity valve plate as recited in claim 1, wherein said valve body is disk-shaped.

8. A multiple cavity valve plate as recited in claim 7, wherein said vacuum cavities are arcuate-shaped.

9. A multiple cavity valve plate as recited in claim 1, wherein said stationary vacuum cavity is configured for connection to a first vacuum source, wherein said moveable vacuum cavity is configured for connection to a second vacuum source, and wherein said second vacuum source supplies vacuum at a greater vacuum level than said first vacuum source.

10. A multiple cavity valve plate for a vacuum drum in a container labeling apparatus, comprising:

a valve body;

a first stationary vacuum cavity in said valve body;

a second stationary vacuum cavity in said valve body; and a moveable vacuum cavity in said valve body, wherein said moveable vacuum cavity is positioned in a floating shoe in a receptacle in said valve body.

11. A multiple cavity valve plate as recited in claim 10, further comprising a spring disposed between said floating shoe and said receptacle.

12. A multiple cavity valve plate as recited in claim 10, wherein said floating shoe includes a vacuum fitting in flow communication with said moveable vacuum cavity.

13. A multiple cavity valve plate as recited in claim 10, further comprising a pressure port in said valve body.

14. A multiple cavity valve plate as recited in claim 10, wherein a said one of said stationary vacuum cavities includes first and second cavity segments interconnected by a channel in said valve body.

15. A multiple cavity valve plate as recited in claim 14, further comprising a vacuum control valve fluidically coupled to said interconnecting channel.

16. A multiple cavity valve plate as recited in claim 10, wherein said valve body is disk-shaped.

17. A multiple cavity valve plate as recited in claim 16, wherein said vacuum cavities are arcuate-shaped.

18. A multiple cavity valve plate as recited in claim 10, wherein said first stationary vacuum cavity is configured for connection to a first vacuum source, wherein said second stationary vacuum cavity is configured for connection to a second vacuum source, wherein said moveable vacuum cavity is configured for connection to a third vacuum source, and wherein said third vacuum source supplied vacuum at a greater vacuum level than said first and second vacuum sources.

19. A multiple cavity valve plate as recited in claim 10, wherein said moveable vacuum cavity is positioned intermediate to said first and second stationary vacuum cavities.

20. A multiple cavity valve plate for a vacuum drum in a container labeling apparatus, comprising:

a valve body;

a first stationary vacuum cavity in said valve body;

a second stationary vacuum cavity in said valve body;

a floating shoe positioned in a receptacle in said valve body, said floating shoe having a third vacuum cavity, said third vacuum cavity positioned intermediate to said first and second vacuum cavities; and a pressure port in said valve body.

21. A multiple cavity valve plate as recited in claim 10, further comprising a spring disposed between said floating shoe and said receptacle.

22. A multiple cavity valve plate as recited in claim 20, wherein said floating shoe includes a vacuum fitting in flow communication with said third vacuum cavity.

23. A multiple cavity valve plate as recited in claim 20, wherein a said one of said stationary vacuum cavities includes first and second cavity segments interconnected by a channel in said valve body.

24. A multiple cavity valve plate as recited in claim 23, further comprising a vacuum control valve fluidically coupled to said interconnecting channel.

25. A multiple cavity valve plate as recited in claim 20, wherein said valve body is disk-shaped.

26. A multiple cavity valve plate as recited in claim 25, wherein said vacuum cavities are arcuate-shaped.

27. A multiple cavity valve plate as recited in claim 20, wherein said first stationary vacuum cavity is configured for connection to a first vacuum source, wherein said second stationary vacuum cavity is configured for connection to a second vacuum source, wherein said moveable vacuum cavity is configured for connection to a third vacuum source, and wherein said third vacuum source supplies vacuum at a greater vacuum level than said first and second vacuum sources.

* * * * *